US007431255B2

(12) United States Patent
Pulido

(10) Patent No.: US 7,431,255 B2
(45) Date of Patent: Oct. 7, 2008

(54) ITEM CADDY

(76) Inventor: David Pulido, 15910 Beechnut St., Houston, TX (US) 77083

( * ) Notice: Subject to any disclaimer, the term of this patent is extended or adjusted under 35 U.S.C. 154(b) by 0 days.

(21) Appl. No.: 11/529,862

(22) Filed: Sep. 30, 2006

(65) Prior Publication Data

US 2008/0078910 A1 Apr. 3, 2008

(51) Int. Cl.
*A47F 5/00* (2006.01)

(52) U.S. Cl. ..... 248/309.1; 211/70.3; 224/274

(58) Field of Classification Search ..... 248/309.1, 248/310, 314; 131/187, 240.1, 241; 224/547, 224/666, 250, 269, 274; 211/60.1, 85.18, 211/70.3

See application file for complete search history.

(56) References Cited

U.S. PATENT DOCUMENTS 3,001,529 A 6/1961 Watson et al.
3,888,265 A * 6/1975 Yount ..... 131/260
5,813,414 A * 9/1998 Zutler et al. ..... 131/241
5,868,143 A * 2/1999 Nielsen ..... 131/329
6,363,941 B1 4/2002 Combs
D385,059 S 2/2004 Cervantes et al.
7,000,617 B2 2/2006 Cervantes et al.
2003/0000536 A1 1/2003 Heffernan
2005/0057921 A1 * 3/2005 Menosky ..... 362/110

* cited by examiner

*Primary Examiner*—Ramon O Ramirez
(74) *Attorney, Agent, or Firm*—Erik J. Osterrieder; Schubert Osterrieder & Nickelson PLLC

(57) ABSTRACT

A device including a wooden, metal or plastic substrate having at least a back surface, a front surface, and a depth portion located between the back surface and the front surface. Further, the device includes an indentation having a length and a width on the front surface, wherein the length is longer than the width and the length is oriented perpendicular to the depth portion. Further still, the device includes an attachment apparatus connected to the back surface, wherein the attachment apparatus is for attaching the device to an object, such as a golf bag. Yet further, the device includes an adjustable strap connected to the device and traversing at least the width. Thereby, the device allows one or more items, such as a pen, pencil, cigar or cigarette, to be placed in the indentation and securely held in place by the adjustable strap, such as an elastomeric band.

35 Claims, 4 Drawing Sheets

ITEM CADDY

FIELD OF INVENTION

The invention generally relates to a caddy for holding an item, such as a pen, pencil, cigar, or cigarette by removably or permanently attaching the caddy to an object, such as a golf bag.

BACKGROUND

Golf originated from a game played on the coast of Scotland during the 15th century. Golfers would hit a pebble instead of a ball around the sand dunes using a stick or club. After 1750, golf evolved into the sport as we recognize it today. During the 1880s, golf bags first came into use.

During a golf game, a person uses golf clubs to hit a golf ball, may wear cleated golf shoes while "on the green," may also smoke cigar or cigarettes and/or use a stylus, such as a pen, pencil, or PDA stylus. Over the years, a number of accessories have been designed and marketed to help golfers clean their clubs, balls, shoes and cleats, as well as to cut cigar tips. Unfortunately, these tools take up valuable space in a golf bag or cart and can become easily misplaced.

As previously stated, golfers may smoke cigarettes or cigars while playing golf When a smoking golfer prepares to take a golf swing or stroke, the golfer typically lays the lighted cigarette or cigar on the ground. This unsanitary practice subjects the cigar or cigarette, and ultimately the golfer, to poisons or injurious chemicals on the ground. The same is true as to placing a pen, pencil or stylus on the ground. In addition, the foregoing items are more susceptible to being lost or forgotten on the green.

Despite advances in accessories, problems remain. One solution is to use a golf smoke tee, which is a golf tee with a cradle on top for holding objects such as cigars or cigarettes above the ground. One such golf smoke tee is described in U.S. Pat. No. 3,001,529, filed May 9, 1958, issued to Watson. The golf smoke tee disclosed in the Watson patent, however, is described as being about 1" to 2½" tall. This may pose problems for golfers who experience back problems. The golfer may need to strain his/her back to bend over and use such a golf smoke tee. An alternative cigar holder is shown in U.S. Design Pat. No. D385,059, filed on Aug. 7, 1996, and issued to Jenkins, which suggests a much taller vertical shank. Jenkin's design patent, however, does not a show or suggest a means for conveniently driving the holder securely into the ground. And, another patent described in U.S. Pat. No. 7,000,617, filed Mar. 18, 2003, issued to Cervantes, discloses a cigar holder with an elongated shaft that is 3-5 feet tall and sticks into the ground. This may pose problems because it adds weight and is a cumbersome tool to carry, especially for golfers who have limited space in their golf bag.

In light of the foregoing, a need, therefore, exists for an improved device for carrying a cigar, cigarette, pen, pencil, or other stylus, for example, is desirable. It is noteworthy that although the disclosed device may be used by a golfer for attachment to an object, such as a golf bag, the disclosed invention may hold any item that fits into the indentation of the device, and the device may attach to any device permitting an attachment other than just a golf bag.

SUMMARY OF THE INVENTION

An example embodiments of the invention generally provide a device including a wooden, metal or plastic substrate having at least a back surface, a front surface, and a depth portion located between the back surface and the front surface. Further, the device includes an indentation having a length and a width on the front surface, wherein the length is longer than the width and the length is oriented perpendicular to the depth portion. Further still, the device includes an attachment apparatus connected to the back surface, wherein the attachment apparatus is for attaching the device to another device. Yet further, the device includes an adjustable strap connected to the device and traversing at least the width. Thereby, the device allows one or more items, such as a pen, pencil, cigar or cigarette, to be placed in the indentation and securely held in place by the adjustable strap.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE EMBODIMENTS

The following is a detailed description of example embodiments of the invention depicted in the accompanying drawings. The embodiments are examples and are in such detail so as to clearly communicate the invention. However, the amount of detail offered is not intended to limit the anticipated variations of embodiments; on the contrary, the intention is to cover all modifications, equivalents, and alternatives falling within the spirit and scope of the present invention as defined by the appended claims. The detailed descriptions below are designed to make such embodiments obvious to a person of ordinary skill in the art.

Generally speaking, a device is disclosed that attaches to another object, such as a golf bag, and holds one or more items, such as a cigar or pencil, in an indentation of the device by an adjustable strap, such as an elastomeric band, that is connected to the device. Now, a more detailed description of the invention is disclosed.

Figure 1:
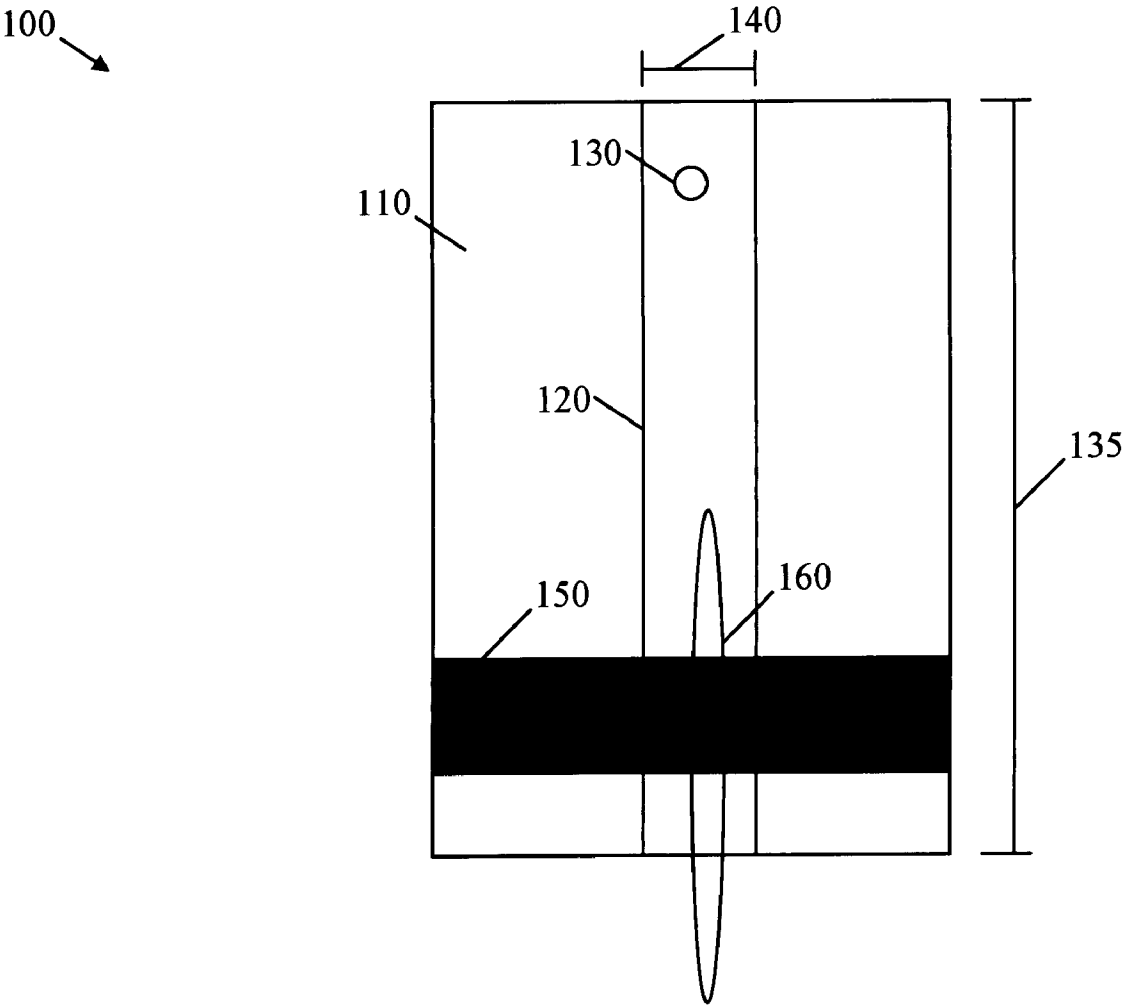
FIG. 1 depicts a front view of the device as discussed herein and in accordance with the disclosed invention.

Turning now to a more detailed description and referring the figures, FIG. 1 is a frontal view of the device 100. The substrate's front surface 110, as well as the entire device 100, itself may be constructed from wood, metal, and/or plastic.

For example, from a decorative and robustness standpoint, the device 100 may be constructed from an aesthetically pleasing hardwood such as oak or cherry. In addition and in the alternative, the device 100 may be constructed from a metallic substance, such as chrome, brass, or steel, and/or a moldable plastic. Although wood may be used, metal and plastic are generally preferable because they are oftentimes stronger and less likely to fracture or splinter.

FIG. 1 also shows an indentation 120 that traverses the length 135 of the front surface 110 of the device 100. In example embodiments, the length 135 is three inches and the width 140 of the indentation 120 is one inch; these are just example dimensions, however, and variance from these examples may be as small or large as deemed necessary to meet the purpose of the one or more items 160 to be held in place by the device 100. As just suggested, the indentation 120 is where one or more items 160 may be stored securely in place by an adjustable strap 150 that traverses at least the width 140 of the indentation 120. Typically, the indentation 120 is a groove or concavity that is capable of receiving for placement one or more items 160, such as a cigar, smoking pipe, cigarette, or stylus, e.g., pen, pencil, or PDA stylus. That is, the one or more items 160 are held in place, even when the device 100 is held parallel with the gravitational force, because of the adjustable strap 150, such an elastomeric band. Finally and although discussed in more detail below, the device 100 may include at least one hole 140 that traverses the depth portion of the device 100, wherein the depth portion is perpendicular to the length 135 and width 140. The optionally threaded hole 130 is for a user to adjust a screw or the like that then adjusts a space within the aperture for the attachment apparatus associated device 100 so that it 100 may attach to another object, such as a golf bag.

Figure 2:
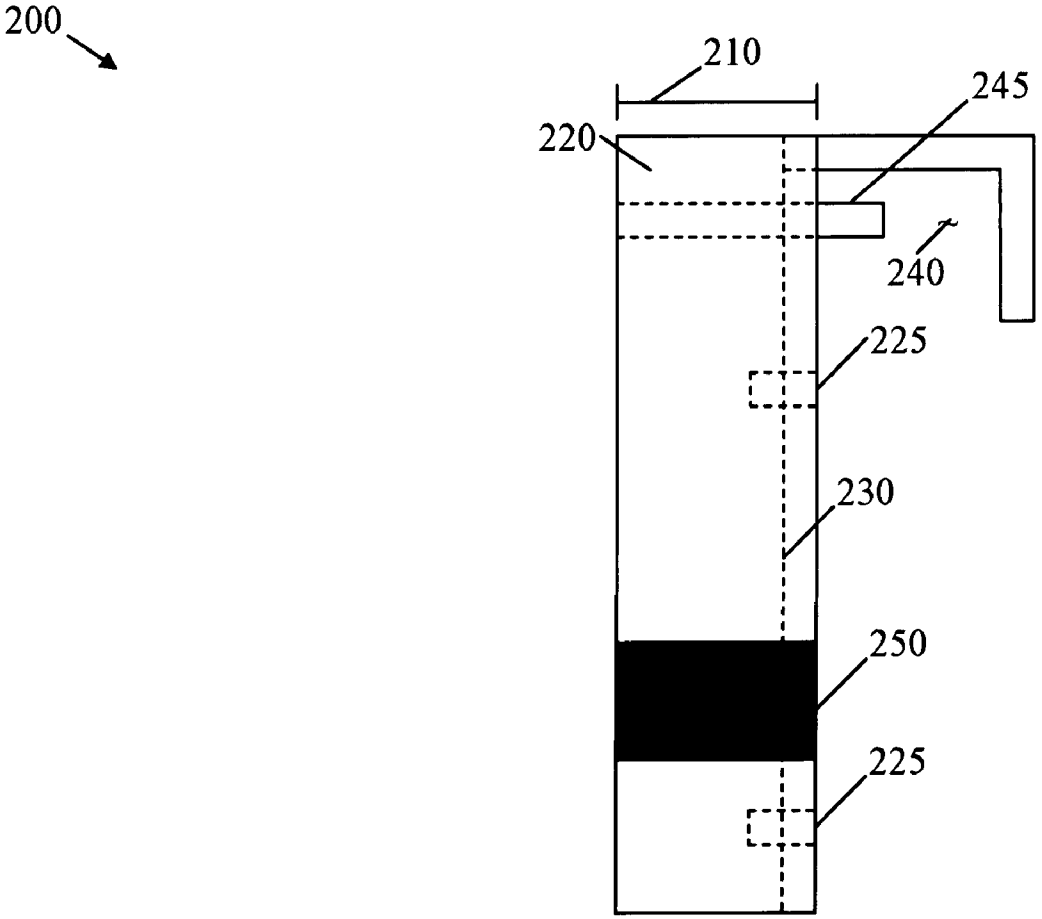
FIG. 2 depicts a side, cross-sectional view of the device shown in FIG. 1 and as discussed herein and in accordance with the disclosed invention. More particularly, this drawing shows part of the attachment apparatus countersunk into the substrate of the device.

Moving on, FIG. 2 shows a cross-sectional side view of the device 200. This substrate's side 220 of the device 200 shows the part of the attachment apparatus 230 as being countersunk into the device 200. Specifically, FIG. 2 shows the cross-sectional view of two holes 225 that partly traverse the depth portion 210. These two holes 225 are for receiving screws or the like in order to securely connect the attachment apparatus 230 to the device 200. Acceptable dimensions for these holes 225 have been shown to be a quarter to one-half of an inch based on the previously disclosed length 135 of three inches and the width 140 of the indentation 120 being one inch.

Figure 4:
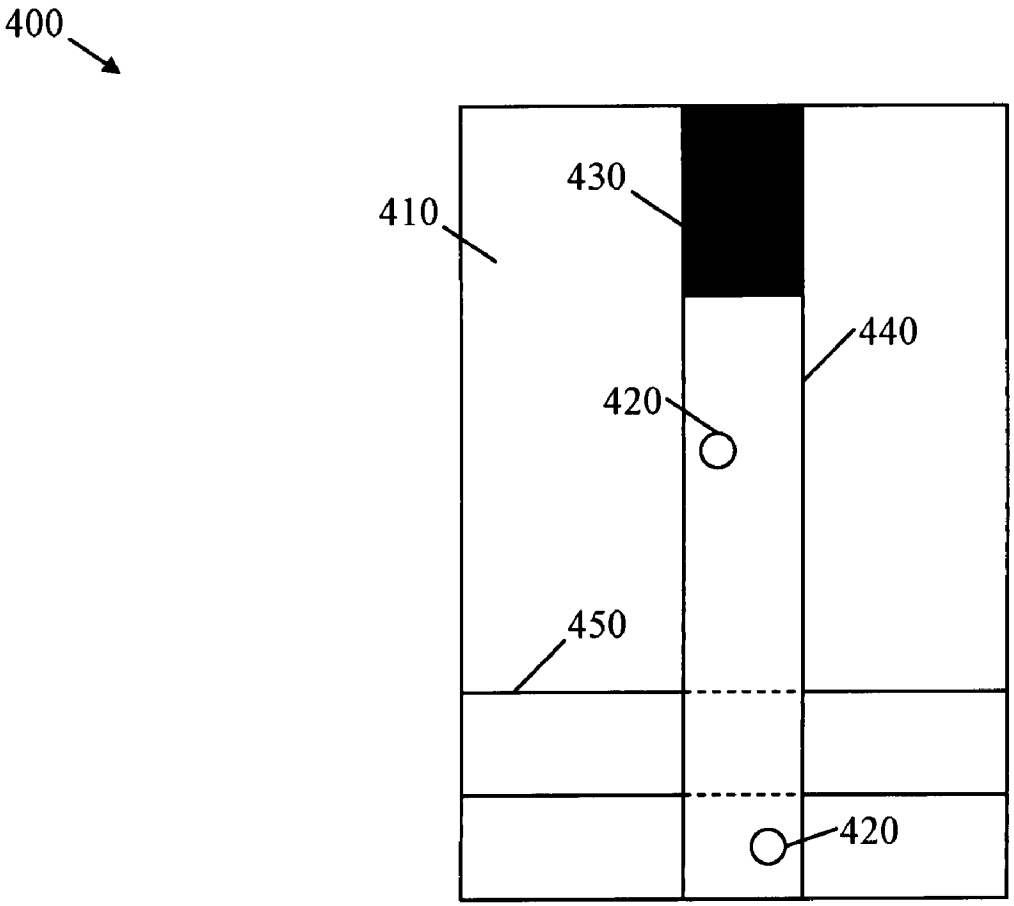
FIG. 4 depicts a rear view of the device as discussed herein and in accordance with the disclosed invention.

In this example embodiment, the attachment apparatus 230 forms an what is deemed an inverted "J" shape. The linear portion of this inverted "J" shaped attachment apparatus 230 is flush with the back surface 410 as shown in FIG. 4; the screws going into holes 225 are countersunk with the substrate's back surface 410 of the device 200. The hook portion of the inverted "J" shaped attachment apparatus 230, however, is facing away from the substrate's front surface 110, which is shown in FIG. 1. The space of the aperture 240 is adjusted by adjusting the screw into the hole 245. Screwing it into the depth portion makes the space of the aperture 240 larger; the converse is also true. The aperture 240 should be adjusted so that the resulting aperture 240 through adjusting the screw into the hole 245 renders a removable or permanent attachment of the device 200 to a particular object, such as a golf bag. In this example embodiment, the hook portion of the attachment apparatus 230 may be said to hook onto the object. In alternate embodiments and instead of the inverted J shape shown, the attachment apparatus 230 may be a hook, fastener (e.g., sliding a button located on the attachment apparatus into a button receiving sleeve located on another object, or vice versa; or, a male snap-button located on the attachment apparatus and female snap-button located on another object, or vice versa), or through complimentary Velcro® strips located on both n the attachment apparatus and the object.

Also depicted in FIG. 2 on this substrate's side 220 of the device 200 is the adjustable strap 250. In this instance, the adjustable strap 250 surrounds the perimeter of the device 200, and that is why it is shown in FIG. 2. It 250 may be held in place by an adhesive substance, or, as shown in FIG. 4, by tension through its placement between a part of the attachment apparatus 245 and the substrate's back surface 410 as shown on FIG. 4 of the device 200. Although not depicted, but in other example embodiments, the adjustable strap 250 may be held in place by one or more screws that penetrate through the adjustable strap 250 and partly into the depth portion 210 of the device 200.

Figure 3:
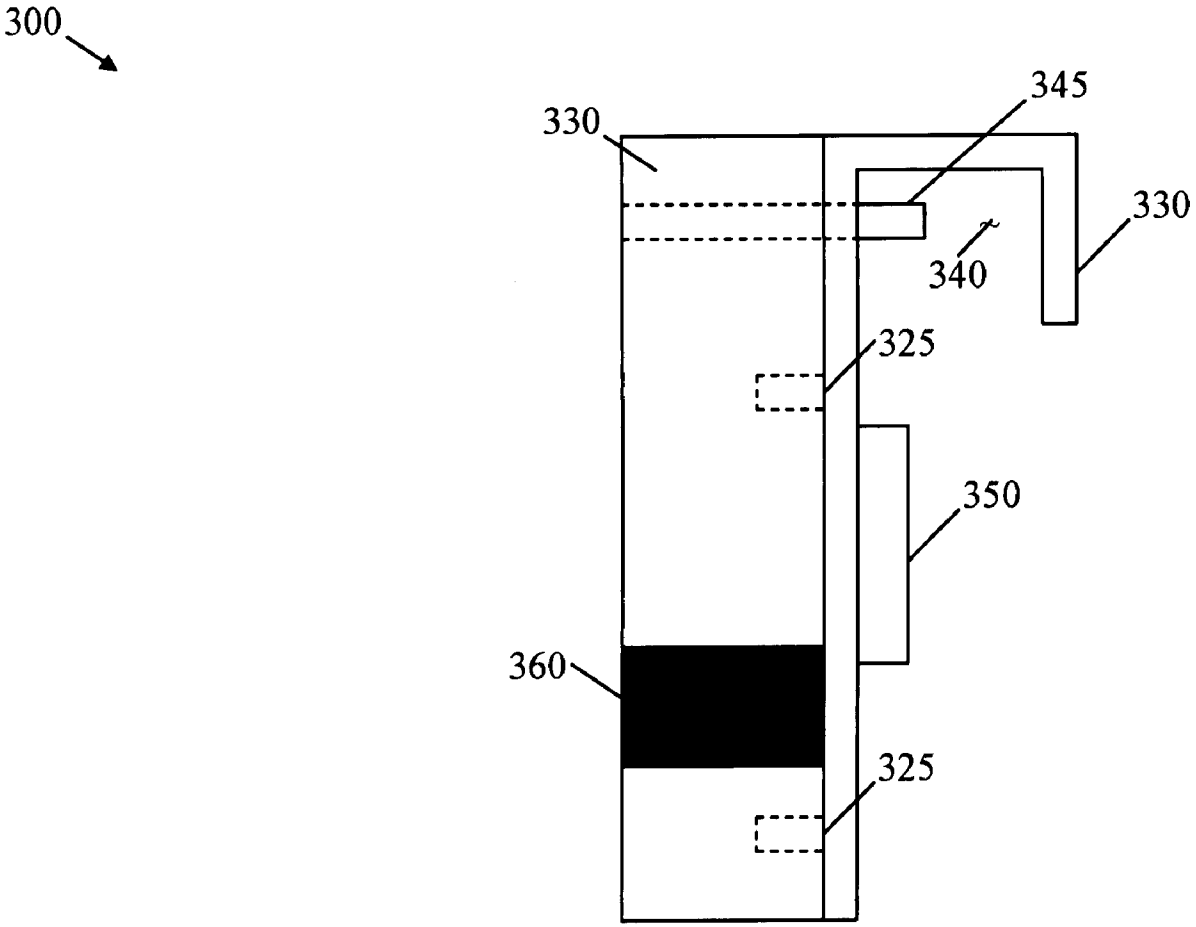
FIG. 3 depicts another side view of the device shown in FIG. 1 and as discussed herein and in accordance with the disclosed invention. More particularly, and unlike FIG. 2, this drawing shows the attachment apparatus affixed, but not countersunk, into the substrate of the device. Furthermore, this drawing shows the optional addition of a Velcro® strip to assist in securing the device to another object also having a complimentary Velcro® strip.

FIG. 3 shows much of the same parts as found in FIG. 2., i.e., one of the substrate's sides 330, two screw holes 325 for receiving screws to secure the attachment apparatus 330 to the device 300. Further, it 300 shows screw with a hole 345, wherein this screw is adjustable to adjust the space of the aperture 340 for attachment of the device 300 to another object. The difference in this FIG. 3, however, is in the placement of the attachment apparatus 330 and the addition of Velcro® 350. Here, the attachment apparatus 330 is not countersunk with the substrate's back surface 410 as shown in FIG. 4. Instead, it 330 is on top of the back surface 410. In addition, FIG. 3 shows the optional additional of a Velcro® strip to assist in securing the device 300 to another object also having a complimentary Velcro® strip.

Although not shown in the drawings, the attachment apparatus is shown as being connected to the device through screws or the like. See FIGS. 2 and 3. Instead, the disclosed device may be formed through the attachment apparatus being integrally connected to the device. That is, the device with the attachment apparatus is a seamless connection, and such may be accomplished most easily through extruded, moldable plastics.

With reference to FIG. 4, it shows the substrate's back surface 410 of the device 400. This view shows the two holes, although it is acceptable to use one or more holes, for receiving screws 420 in order to secure the attachment apparatus 440 to the back surface 410 of the device 400. Notably, these two holes 420 may be catty-corner with respect to each other as depicted, or they may appear elsewhere on the attachment apparatus 440. As depicted in FIG. 4, catty-corner placement may help eliminate torsional strains that the attachment apparatus 430 may undergo.

FIG. 4 also shows a black box, which represents the hook portion 430 of the inverted-J-shaped attachment apparatus 430. The hook portion 430 is entirely black because FIG. 4 is a depiction that looks directly at the substrate's back surface 410 of the device 400; that is, a straight-on view of the device 400.

In another, although non-depicted, example embodiment, a clip, such a small version of a clip used to fasten a bag of potato chips, is used as the attachment apparatus 430. In such an example embodiment, one half of the clip is affixed, possibly with one or more screws of with an adhesive material, to the substrates' back surface 410. The other half of the clip may be opened, for example, by squeezing a top located on the clip. After squeezing the clip, a user may place the opened half of the clip onto an object in the created aperture (e.g., 340 in FIG. 3), an then release the squeezing so that clip is now held firmly onto object, e.g., a golf bag.

The adjustable strap 450 is depicted with a portion of the strap 450 being behind the linear portion 430 of the inverted-J-shaped attachment apparatus 430, and on the substrate's back surface 410. In additional and alternative example embodiments, a portion of the strap 450 may be screwed or the like into place on any surface of the device 400, and/or glued into place with an adhesive, such as an epoxy.

While the foregoing is directed to example embodiments of the disclosed invention, other and further embodiments of the invention may be devised without departing from the basic scope thereof, and the scope thereof is determined by the claims, which may be read in light of the foregoing disclosure, that follow.

What is claimed is:

1. A device, comprising:

a substrate having at least a back surface, a front surface, and a depth portion located between the back surface and the front surface;

an indentation having a length and a width on the front surface, wherein the length is longer than the width and the length is oriented perpendicular to the depth portion;

an attachment apparatus connected to the back surface, wherein the attachment apparatus is for attaching the device to an object;

one or more holes in the back surface for use in connecting, with one or more screws, the attachment apparatus to the substrate;

an adjustable screw located in another hole that traverses the depth of the depth portion, wherein adjusting the adjustable screw varies an aperture for the attachment apparatus, wherein the aperture comprises a space for connecting the device to the object;

an adjustable strap connected to the device and traversing at least the width; and whereby, one or more items placed in the indentation is securely held in place by the adjustable strap.

2. The device of claim 1, wherein the space comprises an area for the attachment apparatus to hang onto the object.

3. The device of claim 1, wherein the substrate comprises wood.

4. The device of claim 1, wherein the substrate comprises metal.

5. The device of claim 1, wherein the substrate comprises plastic.

6. The device of claim 1, wherein the substrate is solid.

7. The device of claim 1, wherein the substrate has a substantially rectangular shape.

8. The device of claim 1, wherein the substrate has a substantially ellipsoidal shape.

9. The device of claim 1, wherein the indentation comprises a concavity into the substrate.

10. The device of claim 1, wherein the one or more items comprises a cigar.

11. The device of claim 1, wherein the one or more items comprises a cigarette.

12. The device of claim 1, wherein the one or more items comprises a smoking pipe.

13. The device of claim 1, wherein the one or more items comprises a stylus.

14. The device of claim 1, wherein the attachment apparatus comprises wood.

15. The device of claim 1, wherein the attachment apparatus comprises metal.

16. The device of claim 1, wherein the attachment apparatus comprises plastic.

17. The device of claim 1, wherein the attachment apparatus is integrally connected to the back surface.

18. The device of claim 1, wherein the attachment apparatus is connected, with an adhesive material, to the back surface.

19. The device of claim 1, wherein the attachment apparatus is connected with one or more screws that traverse one or more holes in the attachment apparatus and screw into the substrate.

20. The device of claim 1, wherein the attachment apparatus comprises a hook.

21. The device of claim 1, wherein the attachment apparatus comprises a fastener.

22. The device of claim 1, wherein the attachment apparatus comprises Velcro®.

23. The device of claim 1, wherein the attachment apparatus comprises a clip.

24. The device of claim 1, wherein the attachment apparatus comprises a portion countersunk into a groove within the back surface and connected thereto.

25. The device of claim 1, wherein the attachment apparatus comprises and inverted "J" shape, wherein the linear portion of the inverted "J" shape is connected to the back surface, and the hook portion of the inverted "J" shape faces away from the substrate.

26. The device of claim 1, wherein the adjustable strap comprises an elastomeric band.

27. The device of claim 1, wherein the adjustable strap surrounds a perimeter of the substrate, wherein the perimeter is perpendicular to the length of the indentation.

28. The device of claim 1, wherein the adjustable strap is connected to the back surface with at least one screw.

29. The device of claim 1, wherein the adjustable strap is connected to back surface with an adhesive.

30. The device of claim 1, wherein the adjustable strap is connected to the device by tension between the back surface and the adjustable apparatus.

31. The device of claim 1, wherein the object comprises a golf bag.

32. The device of claim 1, wherein the device is removably attached to the object.

33. The device of claim 1, wherein the device is permanently attached to the object.

34. A device, comprising:

a substrate having at least a back surface, a front surface, and a depth portion located between the back surface and the front surface;

an indentation having a length and a width on the front surface, wherein the length is longer than the width and the length is oriented perpendicular to the depth portion;

an attachment apparatus connected to the back surface, wherein the attachment apparatus is for attaching the device to an object;

an adjustable screw located in a hole that traverses the depth of the depth portion, wherein adjusting the adjustable screw varies an aperture for the attachment apparatus, wherein the aperture comprises a space for connecting the device to the object;

an adjustable strap connected to the device and traversing at least the width; and whereby, one or more items placed in the indentation is securely held in place by the adjustable strap.

35. The device of claim 34, wherein the space comprises an area for the attachment apparatus to hang onto the object.

* * * * *